US006729369B2

(12) United States Patent
Neas et al.

(10) Patent No.: US 6,729,369 B2
(45) Date of Patent: May 4, 2004

(54) VESSEL FOR CONTAINING/ TRANSPORTING A FLUENT SUBSTANCE

(75) Inventors: Edwin D. Neas, Fort Collins, CO (US); Dennis L. Templar, Fort Collins, CO (US)

(73) Assignee: Chata Biosystems, Inc., Fort Collins, CO (US)

( * ) Notice: Subject to any disclaimer, the term of this patent is extended or adjusted under 35 U.S.C. 154(b) by 377 days.

(21) Appl. No.: 09/772,054

(22) Filed: Apr. 23, 2001

(65) Prior Publication Data

US 2003/0080140 A1 May 1, 2003

Related U.S. Application Data

(63) Continuation of application No. PCT/US99/17280, filed on Jul. 30, 1999, now abandoned.

(60) Provisional application No. 60/094,830, filed on Jul. 13, 1998, provisional application No. 60/094,831, filed on Jul. 31, 1998, and provisional application No. 60/094,896, filed on Jul. 31, 1998.

(51) Int. Cl.[7] ..... B65B 1/04

(52) U.S. Cl. ..... 141/231; 141/94; 141/114; 222/105

(58) Field of Search ..... 141/231, 114, 141/329, 313, 10, 94; 222/1, 81–83, 92, 105, 107

(56) References Cited

U.S. PATENT DOCUMENTS

| | | | |
|---|---|---|---|
| 2,831,610 A | 4/1958 | Dennie | 222/105 |
| 3,112,047 A | 11/1963 | Weinrich et al. | 222/105 |
| 3,930,286 A | 1/1976 | McGowen | 222/83 |
| 4,049,033 A | 9/1977 | Ralston, Jr. | 105/0.5 |
| 4,223,675 A | 9/1980 | Williams | 128/272 |
| 4,465,488 A | 8/1984 | Richmond et al. | 604/414 |
| 4,588,554 A | 5/1986 | Kaartinen et al. | 422/61 |
| 4,842,028 A * | 6/1989 | Kaufman et al. | 141/114 |

(List continued on next page.)

OTHER PUBLICATIONS

UK Patent Application GB 2 180 217 A === published Mar. 25, 1987 inventors Hugh Abel & Gary Tempany.

*Primary Examiner*—Steven O. Douglas
(74) *Attorney, Agent, or Firm*—Macheledt Bales LLP

(57) ABSTRACT

An apparatus (having a flexible-walled vessel compatible with a fluent substance not for direct consumption by mammals) for transporting the fluent substance and dispensing during research, testing, and other related processes. The process is separate from a filling-site where the vessel is filled. The vessel, as oriented by a support framework, has an upper-end and a lower-portion with at least one port through which the fluent substance is dispensed, and an outwardly-facing indicia. This port is in communication with a primary flow channel and a valve for controlling the dispensing of a preselected amount of the substance as needed during the process. The fluent substance is selected from the group consisting of liquid reagents, cleaning solutions, solvents, and/or other fluent substances used in the production process. A second flow channel, in communication with a second port of the vessel's lower-end, may be added for filling the vessel at the filling-site. Also, an associated method of transporting a fluent substance for dispensing during a production/test process that uses a flexible-walled vessel. Additionally, a method (and system) for building an order for replenishing stock of a fluent substance (contained in a flexible-walled vessel with an indicia) for use in a production/test process, including: reading the indicia; transmitting at least a part of the information provided by the indicia to a remote processor; accessing a database with the remote processor to search for a package record that corresponds with the indicia information; using the indicia information, updating and reviewing an inventory file record and generating the order; and once the order is accepted, automatically transmitting a request to determine a shipping-carrier and availability of stock at a warehouse.

29 Claims, 9 Drawing Sheets

U.S. PATENT DOCUMENTS 4,861,556 A 8/1989 Neas et al. ..... 422/78
4,882,286 A 11/1989 Neas et al. ..... 436/175
4,946,797 A 8/1990 Neas et al. ..... 436/175
4,997,083 A 3/1991 Loretti et al. ..... 206/219
5,108,701 A 4/1992 Zakaria et al. ..... 422/21
5,206,479 A 4/1993 Zakaria et al. ..... 219/10.55
5,248,066 A 9/1993 Olson et al. ..... 222/105
5,279,797 A 1/1994 Burns et al. ..... 422/102
5,301,838 A 4/1994 Schmidt et al. ..... 222/95
5,320,804 A 6/1994 Zakaria et al. ..... 422/21
5,343,903 A 9/1994 Winder ..... 141/10
5,462,526 A 10/1995 Barney et al. ..... 604/85
5,465,767 A 11/1995 Harms et al. ..... 141/237
5,505,708 A 4/1996 Atkinson ..... 604/140
5,507,525 A 4/1996 Leuenberger ..... 283/67
5,529,821 A 6/1996 Ishikawa et al. ..... 428/36.91
5,540,892 A * 7/1996 Kidd et al. ..... 422/104
5,560,403 A 10/1996 Balteau et al. ..... 141/9
5,599,303 A 2/1997 Melker et al. ..... 604/80
5,674,741 A * 10/1997 Watanabe et al. ..... 435/283.1
5,697,904 A 12/1997 Raines et al. ..... 604/82
5,721,025 A 2/1998 Falla et al. ..... 428/35.2
5,780,302 A 7/1998 Conlon et al. ..... 436/8
5,783,382 A 7/1998 Aoyama et al. ..... 435/4

* cited by examiner

VESSEL FOR CONTAINING/ TRANSPORTING A FLUENT SUBSTANCE

This application claims benefit of Provisional Appls. Nos. 60/094,830, 60/094,831 and 60/094,896 all filed Jul. 31, 1998 and is a continuation of International Application PCT/US99/17280, with an international filing date of Jul. 30, 1999, now abandoned.

BACKGROUND OF THE INVENTION

In general, the present invention relates to the packaging into a suitable container and transport over some distance, of fluids in liquid form destined for use in a "downstream", or subsequent, manufacturing/product-fabrication/test process. This disclosure is, by and large, not concerned with the transport and administering of medical solutions for mammalian use/consumption (including intravenous delivery of medicines and nutrients to humans and other mammals). But rather, the present invention relates to the novel containment for shipping and ultimate dispensing (preferably gravity fed) for ready use in a manufacturing/product-fabrication/test process (whether the process is deemed part of a commercial enterprise or done in a basic-research facility), of "fluent" substances from the same flexible vessel—without the need for mid-stream staging containers. The flexible walls of the vessel have an outwardly-facing identification indicia (for purposes of tracking/quality control and inventory) and are preferably made of a flexible material compatible with the fluent contents. A portable framework is used to support the vessel when dispensing its contents.

The filling of polymeric bags with liquids for storage and dispensing is not, by itself, new. Modern human and veterinary medicine conveniently uses intravenous fluid ("IV") bags for bedside administration of medicine, nutrients, and other solutions (water, saline solution, dialysis solutions, etc.) to patients in hospitals, nursing-care facilities, clinics, mobile critical-care transporters (life-flight helicopters, ambulances, and medically-equipped airplanes), and to patients who are well enough to have been sent home. Apart from the medical use of polymeric bags-at least one thin flexible bag having a "tent structure" and a multi-component specially-designed dispensing valve has been patented in the U.S. The bag is filled with still wine, shipped, and stored intact until a keeper ring is stripped away so that a sharp plunger is free to thrust inwardly to pierce the bag. Although the patent indicates this tent structure bag can stand up on a table for dispensing, it has not been seen in general use. But rather, wine bags seen in kitchen refrigerators are supported by rectangular cardboard boxes designed for dispensing in a horizontal orientation.

On a much different and greater scale than this, one finds the instant invention. It addresses a need specifically identified by the inventor hereof in the manufacturing/production/test arena (whether for commercial production and/or basic research) for less-costly ways to ship and dispense solutions used in the commercial manufacture, research/bench-testing, fabrication for laboratory/research use, and so on, of products. In the past, the design efforts of storage and transport containers have been driven, by-and-large, by the requirement that the walls of the containers be compatible with the solutions contained therein (such as reagents, organics, cleaning/sterilizing solutions, pesticides, etc.). Glass bottles, although very breakable and heavy to transport, have primarily been the container of choice due to the relative stability of glass and the compatibility of glass with so many solutions. And, while wall-compatibility is an important design consideration of storage vessels (due to the need to use containers made of materials that are substantially inert with respect to corrosion and do not leach extractables into the solutions they contain)—wall-compatibility can no longer be the only major design consideration of solution storage vessels. This is especially true as shipping and handling costs continue to sharply increase; such costs include the additional labor of skilled technicians that must be employed to properly measure/dispense and carefully use (without contaminating) the solutions, the cost of brittle-container breakage during shipment and/or use, as well as costs associated with the sheer weight of hard walled containers.

Due to the ingenious effort and targeted problem identification, the novel apparatus and method of containing for transport and dispensing a fluent substance as well as the novel method of building an order for replenishing stock, disclosed herein, are targeted to processes performed in connection with commercial as well as basic research purposes-including the fabrication and/or analysis/test of products and constituents thereof, whether the product is headed for commercial sale; bench-testing of products and their constituents; beaker cleaning; and so on.

As one can appreciate, unlike the instant invention, known hard-walled storage containers used for transporting solutions delivered to a manufacturing plant or research environment generally require a substantial amount of labor-intensive packing material to surround the containers in order to ship them any distance using common carriers. Although there have been a couple of reagent bags patented as designed for specialized test equipment, these designs do not accommodate large-scale production or bench-test/laboratory use of reagent solutions. Surprisingly, there simply is no adequate low-cost storage-for-transport alternative to the hard-walled containers (made, mostly, of glass and brittle plastics) currently being used for shipping the large quantities of solutions used day-in and day-out in manufacturing and research facilities.

The new apparatus for transporting a fluent substance and method were developed to address the problems associated with shipping heavy, breakable hard-walled containers which are cumbersome to use and store in a manufacturing/test environment. The new apparatus and method, as designed, offer a lower-cost and less labor-intensive alternative that utilizes space more-efficiently while at the same time provides sufficient durability. As can be appreciated, in the spirit and scope of suggested design goals (whether expressly communicated herein) and as described further, the flexible-walled vessels can be fabricated from many suitable materials into many different shapes and sizes, filled with countless different types of reagents, cleaning solutions, solvents, pesticides and other fluent substances, then transported to, and used in, production/test environments (including food production) throughout the world.

SUMMARY OF THE INVENTION

It is a primary object of this invention to provide an apparatus and associated method for transporting in a flexible-walled vessel a fluent substance for ready dispensing there-from during a production/product-fabrication/test process (whether deemed part of a commercial enterprise or done in a basic-research facility). The vessel, which has an upper-end and a lower-portion having at least one port through which the fluent substance is dispensed, can be oriented by a support framework for the dispensing. It is also an object of this invention that such an apparatus and method utilize a valve of some type for controlling the dispensing of a preselected amount of the fluent substance during the process. A further object is to provide a method of building an order for replenishing stock of a fluent substance contained in a flexible-walled vessel having an indicia.

The advantages of providing the new apparatus and associated new methods are as follows:

(a) The inventive vessel is preferably used for one-time dispensing of its contents (and, thereafter, disposed-of). A vessel may be reused by refilling with an identical fluent contents for another dispensing (reuse depends on the level of sterilization needed for its fluent contents, as well as the structural integrity of the flexible material). Regardless of reuse, vessels are preferably reclaimed by recycling the flexible material after its contents has been dispensed.

(b) Versatility—The invention can be used for dispensing reagents, cleaning solutions, solvents, pesticides, etc., used in a wide range of production/testing environments to carry out associated processes (whether carried out as part of a commercial enterprise or done in a basic-research facility) such as: end-product fabrication and/or QC testing; in-line monitoring and/or mixing of constituents of a product; sample bench-testing of end-products or constituents thereof for purposes of quality control (QC); bench-testing of a product undergoing research to assess its manufacturability; plus, testing/sample monitoring, etc., in a 'pure' research sense of a material or substance (e.g., material identification, measuring properties and behavior, and so on).

(c) Simplicity of use—The new vessel allows for reliable transporting to a dispensing site, ease of positioning/orienting for dispensing, plus straightforward repositioning within the process, as necessary, and later removal of the vessel from the process, all without disruption of the production/test environment.

(d) The design of the apparatus and method is such that it allows for handy integration into automated equipment currently in use in the lab or on-the-floor. The use of the apparatus in automated equipment decreases the opportunity for mistakes and safety hazzards associated with making large quantities of chemical reagents and transporting from a mixing site to equipment.

(e) Structural design flexibility-The vessel may be fabricated of flexible stock material (whether tube-stock, sheet-stock, multi-layered, etc.) formed into one of many suitable egonomic shapes of varying capacity depending upon: space available within the production/test process, the fluent substance contained and transported in the vessel, its use in the process, and the specific design of the framework fabricated to support the vessel during dispensing of its contents.

(f) Design for cost-effectiveness—The vessel, as designed, lowers the cost to ship (especially, since the vessel walls are preferably not hard/brittle and heavy), and the novel indicia on the vessel can include many coded pieces of information for cost-effective automatic tracking of vessel 'where-abouts' as well as tracking use of its contents (especially important for inventory control, tracking lots, monitoring product shelf-life, and so on). The new method allows useful information to be provided at a faster rate. By eliminating certain labor-intensive steps in a production/test process, such as the handling, measuring, and sterilization/aseptic-warming of reagents, cleaning solutions, pesticides, and/or other solutions (typically done by skilled technicians), production and lab costs may be greatly decreased.

(g) Design for decreasing the chance of operator error—The novel apparatus and method are targeted to decrease the amount of handling required by technicians during vessel transport and the dispensing of its contents in a production/test process. Operator handling has traditionally included: removing the correct bottle from shelving holding many similarly-shaped hard walled bottles, pouring-out and measuring the requisite amount of the liquid reagent into a clean beaker, warming/sterilizing/mixing the beaker and its contents if necessary, dumping the contents of the beaker into a test tube or vat to carry-out a predesignated step in the production/test process (e.g., a chemical reaction, analysis, the dissolving of a solute, cleaning to remove rust/corrosion, etc.), cleaning the beaker for reuse. Decreasing such operator handling in a production/test process can substantially decrease the costs associated with carrying out the process, especially where highly trained technicians are needed to perform the operator handling (as is most often the case when performing steps to manufacture/produce/test chemicals whether destined for commercial use or done in a research facility).

(h) Design for volume dispensing—The framework incorporated in the apparatus and method of the invention may, as needed, be designed to stage several of the novel vessels simultaneously (for example: several vessels can be hung from a sturdy projection of the framework by passing the projection through an opening fabricated into each of the vessels; several vessels can be oriented between corresponding pairs of forward and aft walls lined up between two extending side strut-walls; or each of a plurality of vessels can be oriented by sliding one of a plurality of vertical stem projections extending upwardly from a base of the framework, through a corresponding channel fabricated into the side of the vessel).

(i) Tracking method simplicity and efficiency—The method of building an order for replenishing stock of the invention is straight-forward to integrate and implement into existing production and lab environments, especially using the novel indicia affixed to a vessel of the invention. This indicia also allows for automatic tracking of product/vessels along the production/test process. In light of strict internal quality control policies and federal regulations, as well as product liability concerns, reducing the number of manual steps required to order (including replenishing stock), track, and 'inventory' fluent substances used in a production/test process makes the overall process more economically feasible and less-prone to operator error.

Briefly described, the invention includes an apparatus (having a flexible-walled vessel compatible with a fluent substance) for transporting the fluent substance and dispensing during a production/test process. The process (whether it is carried out in a production/manufacturing environment or a research-laboratory environment) is separate from a filling-site where the vessel is filled. The vessel, as oriented by a support framework for the dispensing, has an upper-end and a lower-portion. The lower portion has at least one port through which the fluent substance is dispensed during the process. This port is in communication with a primary flow channel and a valve for controlling the dispensing of a preselected amount of the substance as needed. The fluent substance can be selected from the group consisting of liquid reagents, cleaning solutions, solvents, pesticides, and/or other fluent substances used in a production/test type environment (not for direct mammalian consumption). The vessel preferably has an outwardly-facing indicia, and the vessel's upper-end and a lower-end of the vessel's lower-portion can be hermetically formed from sheet material such that: a volume is formed between these two ends having a capacity greater than that required to contain the preselected amount. A second flow channel, in communication with a second port of the vessel's lower-end, may be added for filling the vessel at the filling-site (and, once a vessel is filled, this second flow channel can be blocked re-opened for re-filling). The framework, if used, can have a multitude of suitable structural designs.

The invention also includes a method of transporting a fluent substance for dispensing during a production/test process, including the steps of: providing a flexible-walled vessel with an upper-end and a lower-portion having at least one port in communication with a primary flow channel and a valve; filling the vessel, for the transporting, with the fluent substance at a filling-site that is separate from the production/test process; orienting the vessel (can be by way of a support framework); and dispensing through the valve, as needed, a preselected amount of the fluent substance. Preferably, the flexible-walls are made of a material compatible with the fluent substance and the vessel has an outwardly-facing indicia (whether coded). Again, the fluent substance can be selected from the many reagents, pesticides, and cleaning and other solutions.

Also characterized herein, is a method (and associated system) of building an order for replenishing stock of a fluent substance (contained in a flexible-walled vessel) for use in a production/test process (whether it is carried out in a production environment or a research-laboratory environment). This method incorporates a novel broadened use of such a vessel with an indicia (a portion of which is machine-readable). The steps include: reading the indicia; transmitting at least a part of the information provided by the indicia to a remote processor; accessing a database with the remote processor to search for a package record that corresponds with the indicia information; using the indicia information, update and review an inventory file record (maintained by the remote processor); and generating the order for acceptance and, once accepted, automatically transmitting a request for determining a shipping-carrier and availability of stock at a warehouse. The step of reading the indicia can include using a computerized device to read the portion which is machine-readable, and/or visually reading the indicia and manually inputting a package serial number (PSN) therefrom to an input device at a dispensing location. A first-pass order may be generated and modified (via display), if necessary, prior to acceptance.

There are additional features that further distinguish this method of the invention: Adding the step of awaiting credit approval for the accepted order prior to performing the automatic transmission of a request (and the method may also require that, prior to giving this credit approval, a guarantee of payment of the order must be received by electronic transmission); and, the step of transmitting indicia information preferably includes connecting to a global information network through a modem interconnected to a computer-processing-unit (CPU) at a dispensing location where the production/test process takes place, and accessing a remote modem interconnected to said remote processor.

BRIEF DESCRIPTION OF THE DRAWINGS

For purposes of illustrating the flexibility of design and versatility of the innovative preferred apparatus and method, the invention will be more particularly described by referencing the accompanying drawings of embodiments of the invention (in which like numerals designate like parts). The figures have been included to communicate the features of the invention by way of example, only, and are in no way intended to unduly limit the disclosure hereof.

DETAILED DESCRIPTION OF THE PREFERRED EMBODIMENTS

Figure 1:
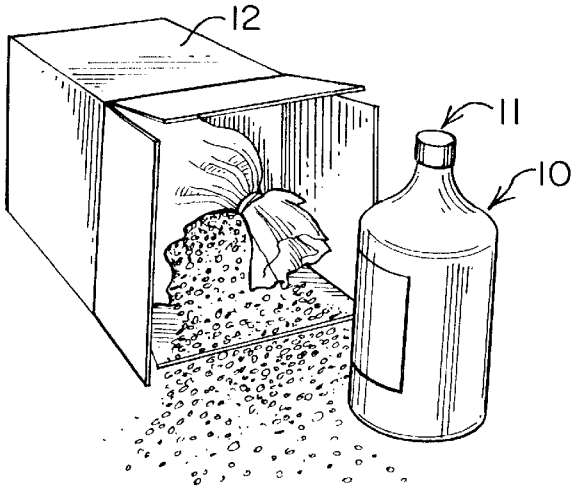
FIG. 1 (PRIOR ART)
FIGS. 1 and 2 are isomeric views of a typical hard-walled container packaging and transport system: A glass bottle with removable cap packed into a sturdy cardboard box with loose packing material (FIG. 1); and a large glass staging beaker into which the solution from the glass bottle is poured for mixing and storage prior to use in a laboratory.
Figure 2:
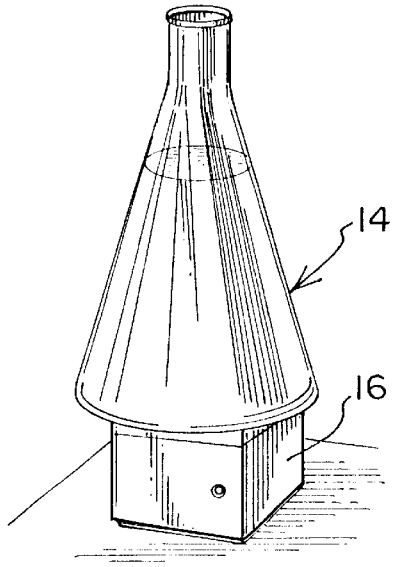
FIG. 2 (PRIOR ART)

As identified above, the handling difficulties encountered by using typical hard-walled container packaging and transport systems currently in use are not hard to imagine: The glass bottles (10) having removable caps (11) often break during shipping; and for those bottles 10 packed well enough in heavy-sturdy cardboard boxes (12) with packing material (FIG. 1) to make it to a destination site in-tact, there are handling concerns along the production line related to storage, pulling of stock, and dispensing. For example, one must tightly grasp the bottle 10, pick it up, tip and pour its contents without spillage into a staging container such as the large glass staging beaker 14 shown in FIG. 2 atop a magnetic mixer (16) for use at some point in a manufacturing/production/test process. In comparing FIGS. 1 and 2 with FIG. 3, one can readily appreciate the advantages of the flexible-walled vessel of the invention 20 in FIG. 3 which has been placed on top of a cardboard separator 22 into packing box 22.

Figure 4:
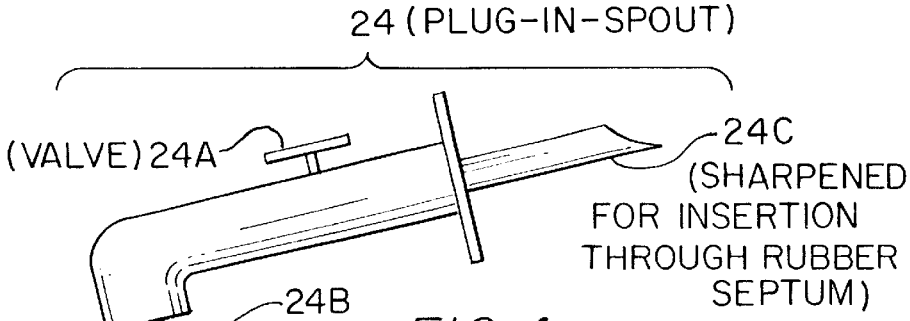
FIGS. 4 and 5 illustrate alternative preferred flexible-walled vessels of the invention
Figure 5:
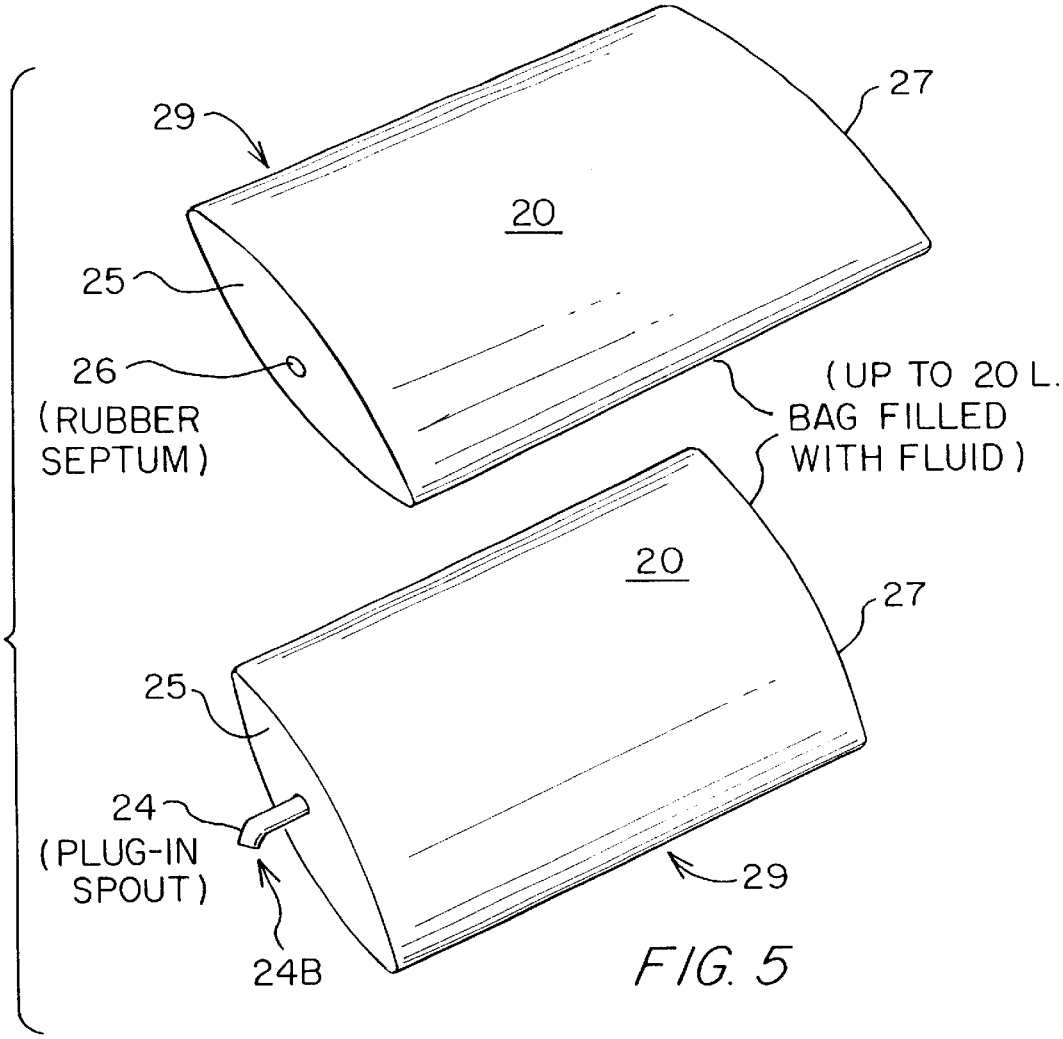

The alternative vessel structure shown in FIGS. 4 and 5 has an upper-end 27 and a lower-portion 29 having at least one port 26 through which the fluent substance can be dispensed during a production/test process. Port 26 is in communication with a primary flow channel 24B and a valve 24A for controlling the dispensing of a preselected amount of the fluent substance contained in the vessel. The plug-in spout 24 has a sharpened end 24C for insertion at 26 to break the initial seal of a rubber septum (located at 26), a suitable valve 24A for controlling flow along channel 24B. A lower-end, in the form of a wall (25) of suitably flexible material, has been hermetically integrated with vessel 20.

Figure 6:
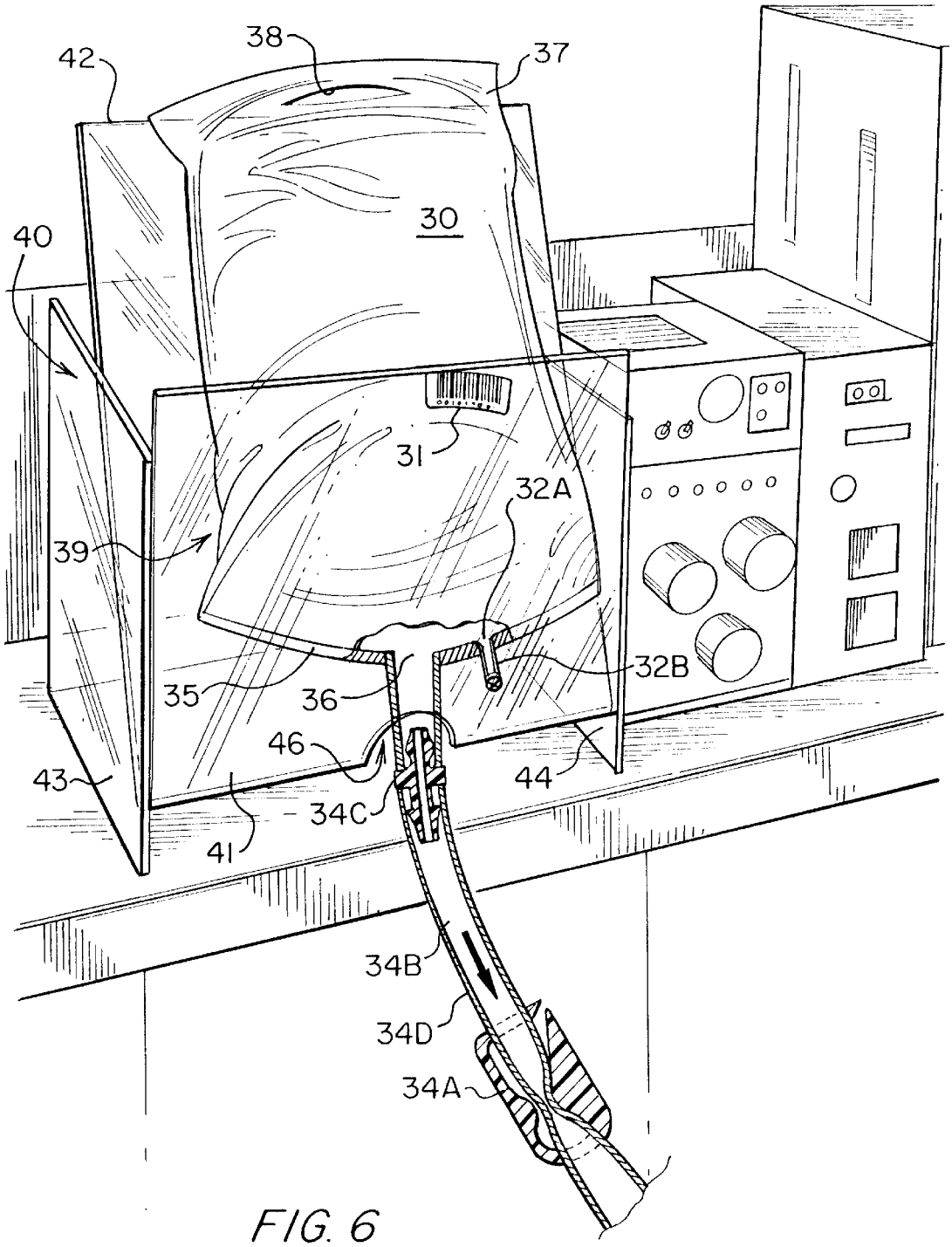
FIGS. 6, 7, and 8 illustrate preferred embodiments of an apparatus of the invention.

The preferred vessel 30 illustrated in FIG. 6 has an upper-end 37 and a lower-portion 39 having at least one port 36 through which the fluent substance is dispensed. Port 36 is in communication with a primary flow channel 34B and an interlocking pinch-clip valve 34A that is engaged to pinch the walls of tubing 34D connected to port 36 via suitable unitary connector 34C. At some point downstream from port 36 (for example, at the point connector 34C has been positioned), a flowmeter device can be readily added to measure flow out of vessel 30; this flow measurement can readily be converted into a measurement of volume dispensed. Devices that take measurements of fluid flow through an orifice of known diameter are available on the market. Alternatively, the vessel may be made with a single piece of tubing an end of which is hermetically sealed directly to the lower-end 35 (eliminating the use of connector 34C). Many suitable connectors and valves may be employed to control the flow along flexible tubing 34D, such as the unitary plastic valve shown at 34A (pinch-clamp distributed by Fresenius Medical Care AG). Here, upper-end 37 and a lower-end 35 of lower-portion 39 have been hermetically formed from polymeric tubular stock material such that: preferably at least the front of the vessel 30 is transparent for viewing the level of its contents; and a pillow-shaped volume of vessel 30 has been formed between ends 35 and 37 having a capacity greater than that required to contain the preselected amount. Also, primary flow channel 34B has been hermetically sealed to prevent leakage and a support opening 38 is integrated within upper-end 37. Although not shown specifically, here, primary flow channel 34B could readily be sealed to extend from along a sidewall of vessel 30. Port 36 can be used for filling, as well as the dispensing, of vessel 30; alternatively, a second port 32A in communication with a second flow channel 32B may be desired for filling, and once the vessel has been filled, this second flow channel can be permanently or temporarily blocked. An indicia 31 is affixed to vessel 30 by suitable means such as stick-backed label, silkscreened onto the flexible wall, connected by way of a pull-tag secured through opening 38, and so on. The indicia can, without being overly large in size, contain many different pieces of valuable information about the vessel 30, its contents, and the purchaser of the filled vessel 30, including a package serial number (PSN) tying the vessel to a lot-number of the batch from which it was manufactured/filled, shelf-life, the stock material used to form the vessel, and so on. The value of indicia 31 can be better appreciated in connection with FIGS. 12 and 13.

One of several preferred support framework structures is shown at 40 in FIG. 6. It is not critical to have such a framework, especially if the vessel is formed into a shape that is self-supportive and can remain oriented for dispensing. Framework 40 is formed of forward and aft walls (41 and 42 respectively) and side strut-walls (43, 44) which have been adhesively interconnected, plus a lower aperture 46 through which a primary flow channel can fit for dispensing the fluent substance. Here, for viewing the level of fluent substance in vessel 30, framework walls 41, 42, 43, 44 have been made of a transparent, plastic-resin material having sufficient structural integrity to orient vessel 30 upright.

Figure 7:
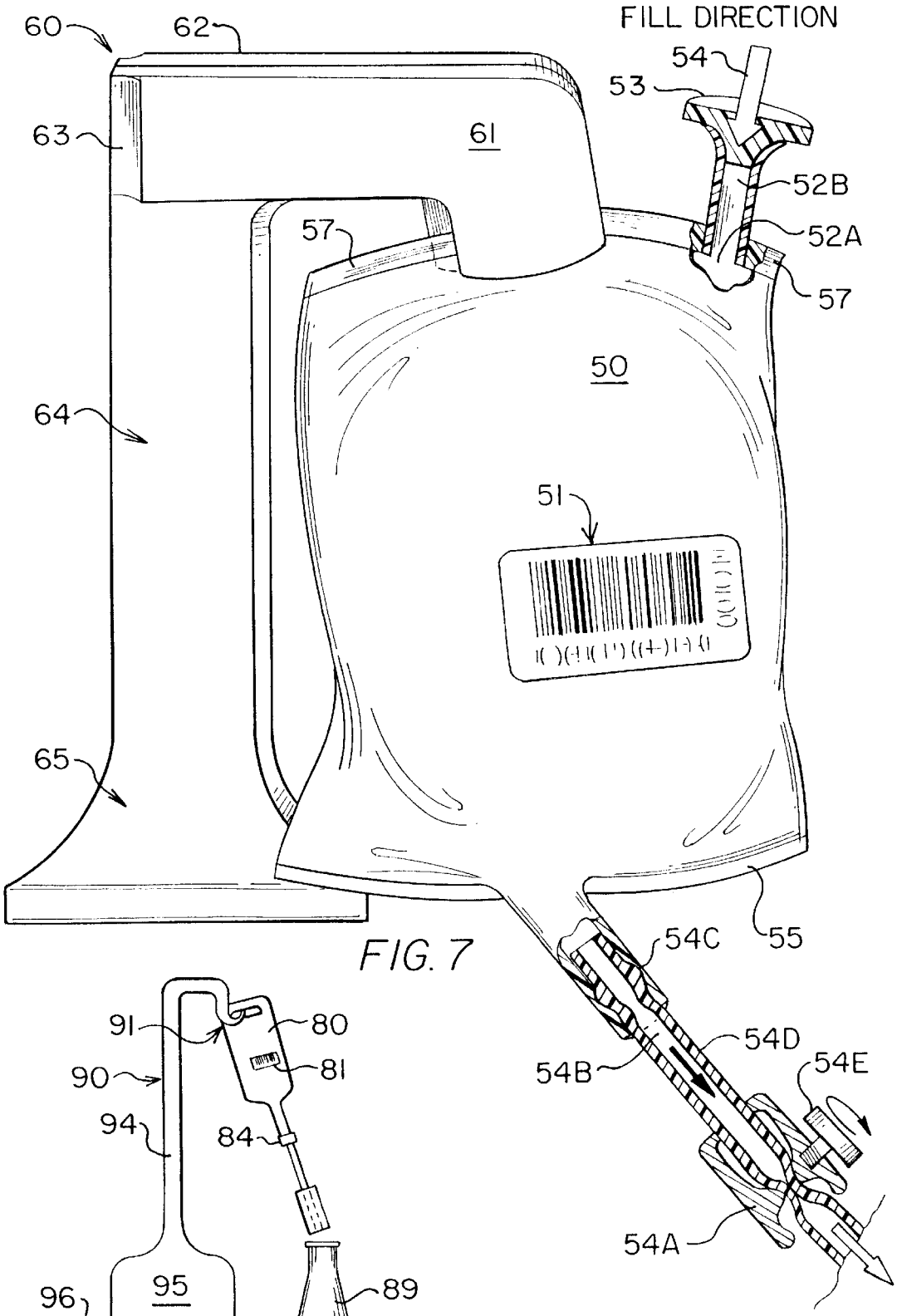
Figure 8:
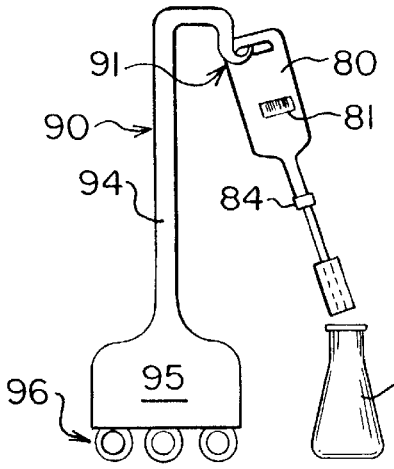

FIG. 7 illustrates an alternative vessel 50 of the invention formed between ends 57 and 55 having indicia 51 and primary flow channel 54B. Flexible tubing 54D may have an integral connector-piece 54C as shown to connect the tubing to the dispensing port. A valve 54A for controlling the dispensing has a knurled set-screw 54E for pinching tubing 54D to stop flow of the substance contained in vessel 50. Second flow channel 52B communicates with a second port 52A for filling along direction (arrow 54); and once filled, suitable plug such as that labeled 53 may be employed to temporarily or permanently block channel 52B. Vessel 50 is oriented by framework 60 having a weighted base 65 and stand 64. Upper-end 57 can be 'pinched' between forward and aft fingers (61 and 62), having first been opened by pivoting the fingers at hinge 63. FIG. 8 illustrates yet another novel apparatus of the invention wherein vessel 80 with indicia 81 and primary flow channel 84 is hung on a projection 91 of framework 90 having a stand 94 and a base 95 with rollers/wheels at 96 for moving the framework 90 from station-to-station within the production/test process, and dispensing, for example, into a container 89.

Figure 10:
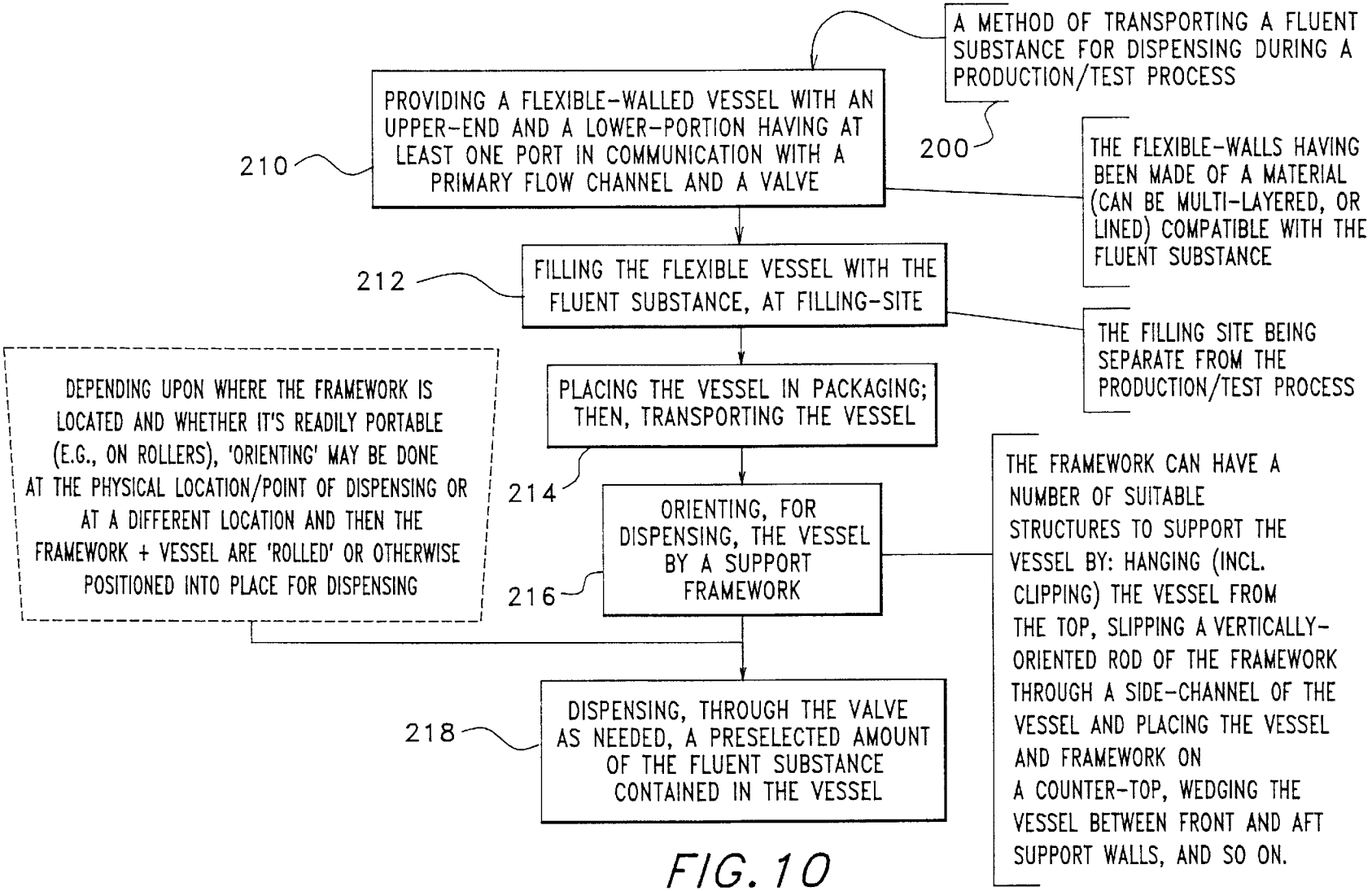
FIGS. 10 and 11 are flow diagrams detailing preferred and alternate steps of a method of transporting a fluent substance for dispensing during a production/test process.
Figure 11:
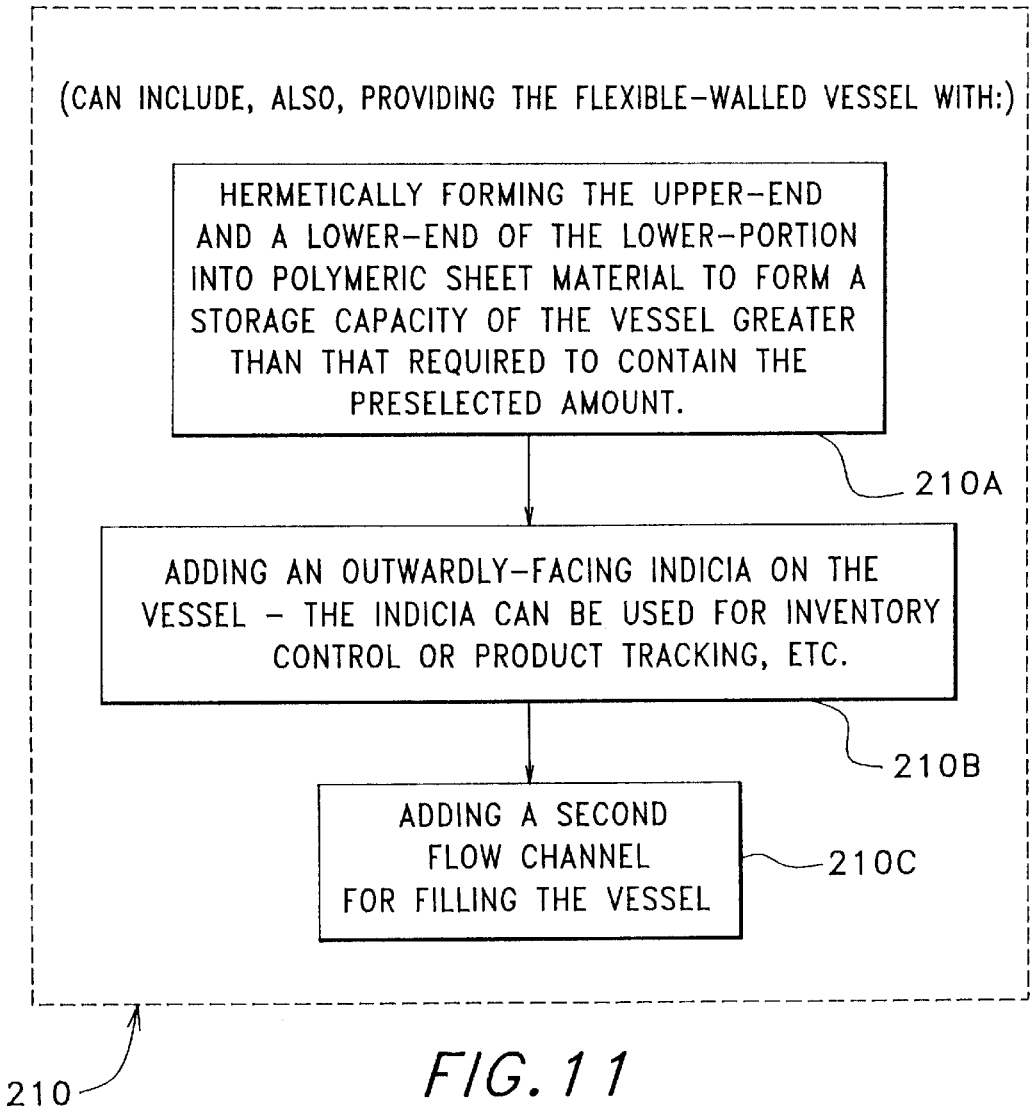
Figure 14:
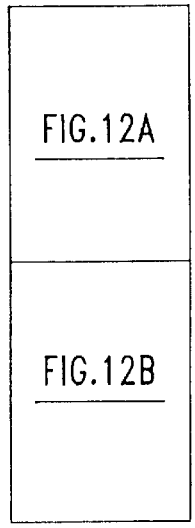
FIG. 14 is a high-level schematic that simply illustrates the relationship between FIGS. 12A and 12B, which together represent core and further distinguishing features of the method of building an order for replenishing stock, according to the invention.
Figure 12A:
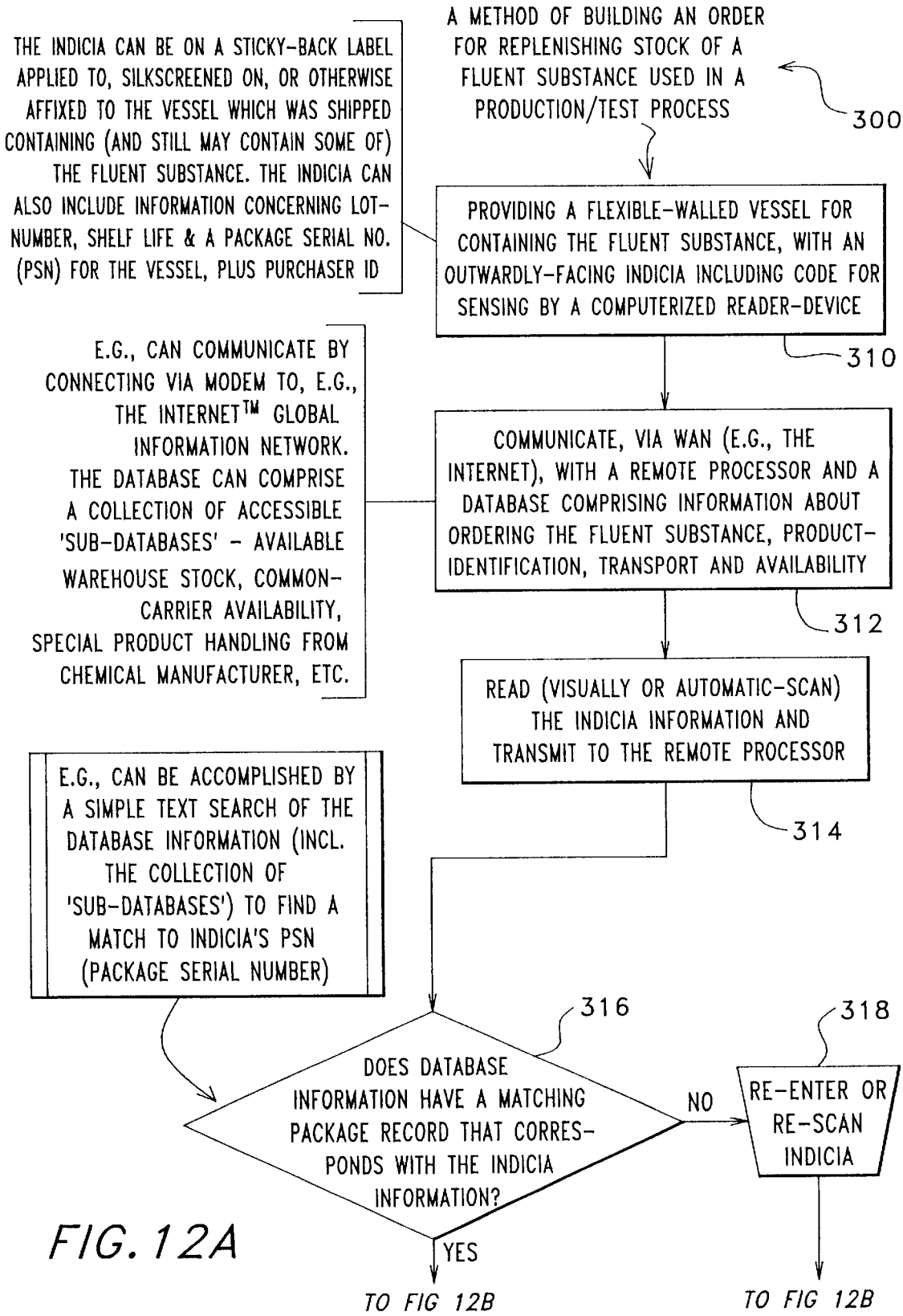
FIGS. 12A and 12B, taken together, represent a flow diagram detailing preferred and alternate steps of a method of building an order for replenishing stock of a fluent substance utilizing, in an expanded novel manner, the indicia on a wall of a flexible-walled vessel of the invention.
Figure 12B:
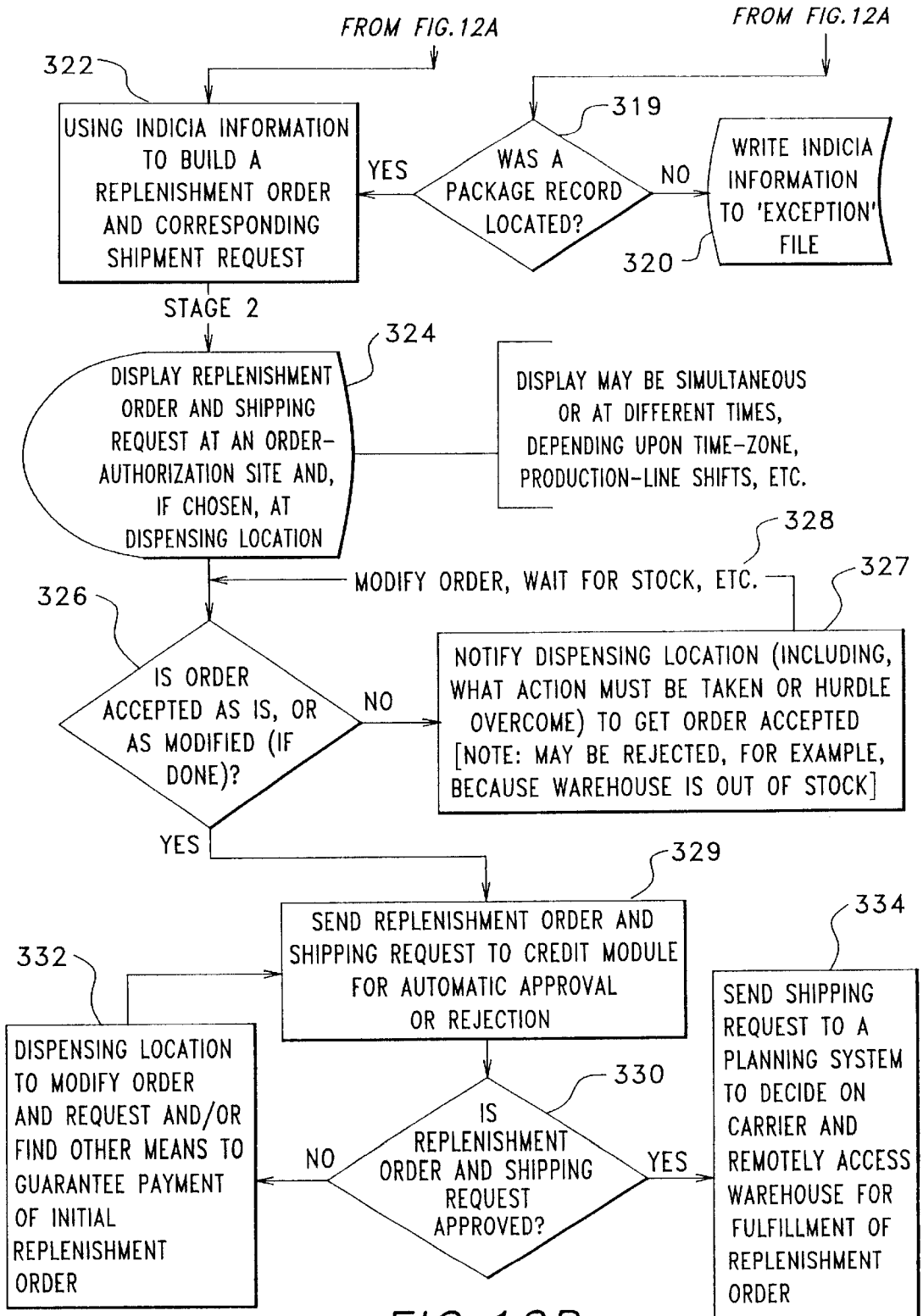
Figure 13:
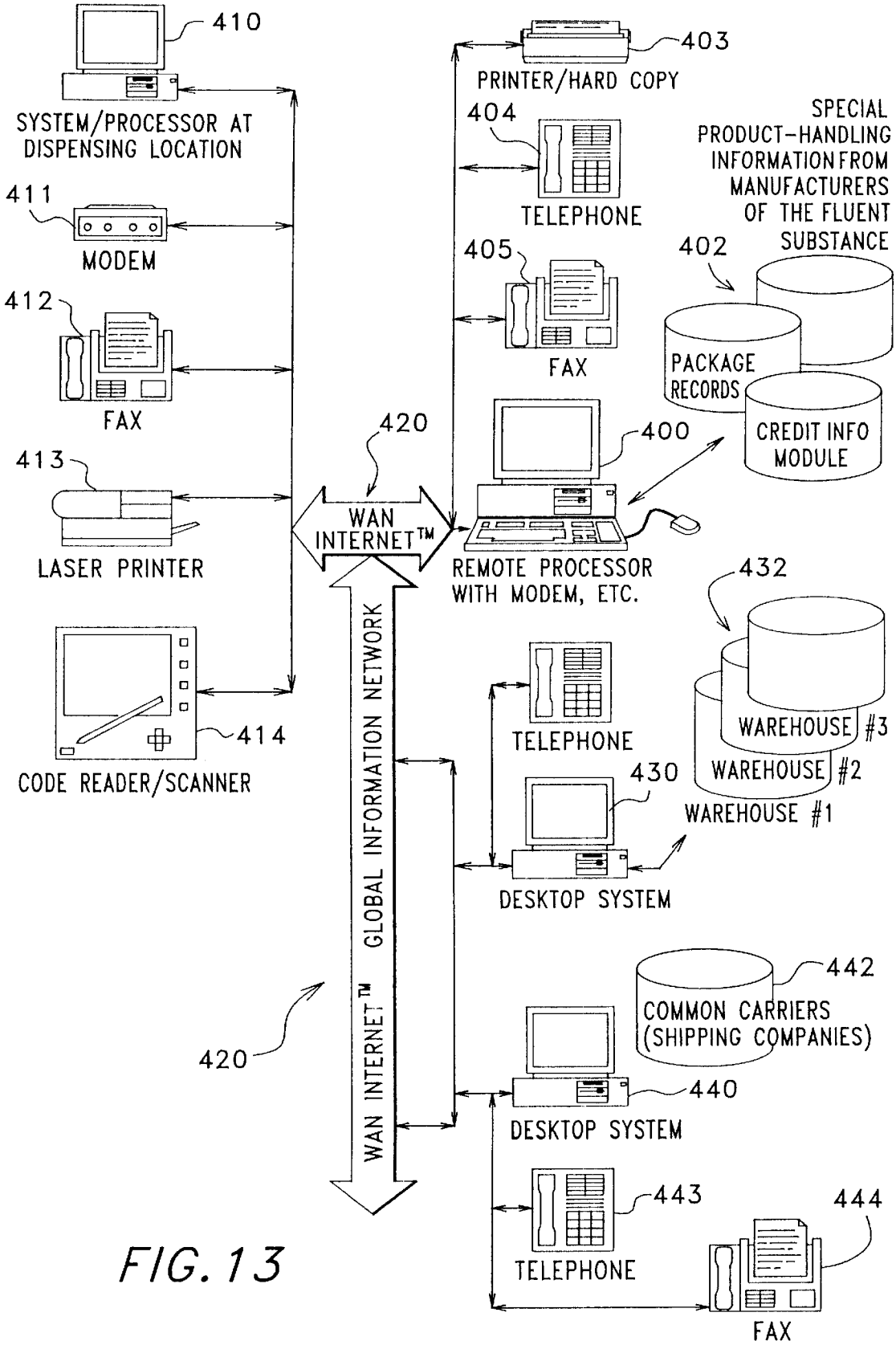
FIG. 13 is a schematic representation of preferred hardware and the interconnections therebetween that may be used to carry out the method represented in FIGS. 12A and 12B, taken together.

The flow-diagrams FIGS. 10, 11, and 12, as well as the hardware-communication schematic labeled FIG. 13, include additional written detail for convenient viewing to better appreciate the novel features of the invention. Turning, first, to box 210 in FIG. 10, preferably, the flexible-walled vessel is compatible with the fluent substance it contains: Not only is it preferable that the stock material be inert but that the amount of chemical 'extractables' that leach into the substance be negligible and undetectable by normal testing procedures used in laboratories. Examples of suitable commercially-available polymeric materials for building a vessel include flexible poly-vinyl chloride (PVC) film and CRYOVAC® M312 multi-layer film distributed by Cryovac Sealed Air Corporation. Sealed Air Corp. describes its CRYOVAC® M312 film product as an "alternative to glass bottles, poly-propylene and polyethylene materials" that is a "highly inert, very clear material that exhibits extremely low extractables in a wide variety of solutions." Next (box 212), fluent substances as used herein include the multitude of substances considered flowable, or capable of flowing such as reagents, cleaning solutions, water (with many uses, including use as an inorganic solvent), organics, pesticides, and other substances used in a production/test type environment. 'Reagent', as defined, is any chemical compound used in laboratory analyses to detect and identify specific constituents of the material being examined. Though reagents may be gases, liquids, or solids, they are usually prepared as solutions (in water or common solvents) of various concentrations, e.g., 1 molar, 0.1 normal, etc. Several thousand chemicals of varying specificity are used as reagents; they are subject to strict specifications, especially as regards purity. A non-exhaustive list of reagents includes, without limitation: glacial acetic acid; sulfuric acid; hydrogen sulfide; dimethylglyoxime; potassium iodide; 0.05 M Potassium Phosphate, pH 7.5; Sodium Acetate Buffer Solution, pH 5.0; 0.5% SLS in 0.1 M Phosphate Buffer (pH 8.0); 0.05 M Potassium Phosphate, pH 6.8; 0.025 M Phosphate pH 3.2, has Phosphoric and Acetic Acid; 0.05 M Sodium Phosphate pH 6.8; 0.2% diethylamine in 0.2 M Potassium Phosphate. Generally, 'solvent' is a term that designates a liquid which can reduce certain solids or liquids to molecular or ionic form by relaxing the intermolecular forces that unite them. There are tens-of-thousands of solvents currently in use.

Figure 3:
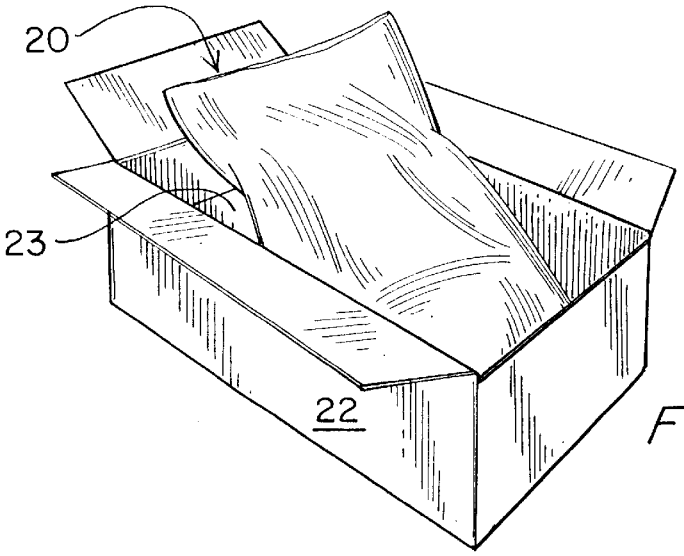
FIG. 3 is an isometric view of a preferred packaging and transport system of the invention.

Prior to transport over any distance, the vessel is packaged 214 (see, also, FIG. 3 at 22). Then, either at the physical location/point of dispensing, or at a separate location, the vessel may be oriented by a support framework having a suitable structure corresponding with the specific structural design of the vessel. In the event a vessel is formed in such a manner that it can be oriented on its own, it is not critical that a support framework be used. As noted, the framework can have a number of suitable structures to support the vessel by: hanging (including, clipping as shown in FIG. 7) from the upper-end of the vessel, sliding a vertical rod of a counter-top framework through a side channel of the vessel, wedging the vessel between front and aft support walls (see, FIG. 6), and so on. Once positioned in place at the physical location of dispensing, a preselected amount, as needed, of the fluent substance is dispensed (218). As detailed in FIG. 11, and discussed above, step 210 can further include: 210A, hermetically forming the ends (e.g., FIG. 7 at 55, 57) of sheet-stock to form a desired storage capacity (preferably from about 5 milliliters to 20 Liters in volumetric-capacity); 210B, adding indicia (whether coded) for use in product tracking and inventory control; and 210C, including a second flow channel (for example, see FIG. 7 at 52B).

By way of example only, and not intended to specifically limit the disclosure hereof, a flexible vessel can be constructed of fluid and microbial impervious flexible sheet material that has minimal gas permeability to aid in maintaining the integrity of the chemistries packaged in the vessel (which, depending upon use, may be sparged or otherwise treated before being packaged in a flexible vessel). Preferably, to reduce shipping costs, the total weight of the flexible vessel is less than the weight of a hard-walled (e.g., glass or high-density polyethylene plastic) container large enough to hold an equivalent volume of liquid. The flexible material can be of a multi-layer construction, and in the event the contents of the vessel, once filled, requires some type of treatment (e.g., sterilization, electron beam irradiation, gamma irradiation, and so on), preferably a flexible material is used that can withstand such treatment with minimal, or no, degradation. One use for the packaged chemistries of a vessel of the invention, is during the process of High Performance Liquid Chromatography (HPLC). Such chemistries include high-purity water ($H_2O$), numerous buffered reagents, and organic solvents.

FIGS. 12 and 13 represent the flow of a preferred method of building an order for replenishing stock of a fluent substance utilizing, in an expanded manner, indicia (such as that shown at 31, 51, 81) on a wall of a flexible-walled vessel. Commercially available 'supply chain' software tools fall short of effective comprehensive use of the INTERNET® global information network and wireless (cellular) technologies to handle ordering and fulfillment of orders for reagents and other solutions used in a production/test environment. Each of the commercially available products only addresses one segment of the supply chain: There are "enterprise-wide" systems (such as those distributed by the German company SAP, the European-based Baan, Oracle Corporation, and PeopleSoft, Inc.) and there are warehouse management software suppliers (Catalyst, EXE, and Manhattan) who have developed warehousing solutions.

Turning, to FIG. 12, a vessel with indicia is preferably used (box 310) in connection with the method of building an order. A portion of the indicia is encoded for reading/sensing with a reader-device interconnected to a computer, such as the handheld device illustrated in FIG. 9 at 100 to read/scan indicia 31 of vessel 30. Preferable modes of affixation of indicia (31) to a vessel (e.g., that shown at 30), have been discussed in connection with FIG. 6. As shown in more detail in the schematic labeled FIG. 13, a remote processor must be (at 400) capable of accessing database information 402, represented here as separable 'local' databases of credit information and package records, which may incorporate special product-handling information from the manufacturer, and if not, a separate database of manufacturer records can be used. Also, if local database records 402 do not include warehouse stock and common carrier information, the remote processor 400 should preferably be able to access such information via WAN 420 (e.g., INTERNET® global information network via modem, both through hardwired phone lines and cellular communication networks) to additional 'sub-databases' (e.g., warehouse stock availability 432 and common carrier location, cost, and availability 442).

Figure 9:
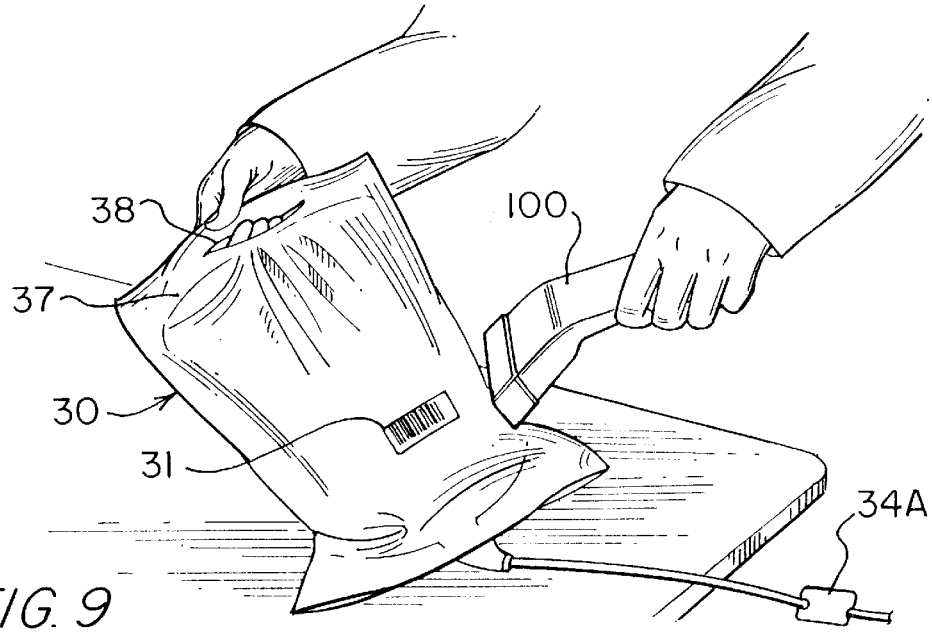
FIG. 9 illustrates a preferred vessel of the invention along with a bar-code reader.

The indicia is read 314 (visually or automatically by suitable electronic device, e.g., FIG. 9 at 100 and FIG. 13 at 414) and at least certain of the indicia information is transmitted to a remote processor (400 in FIG. 13). If the accessible database information (including 402, 432, 442) does not have a package record that corresponds with the transmitted indicia information 316, then the indicia information can be re-entered (318) and if no package record is matched the second time (319), the indicia information may just not be in the database, yet: Write it to an 'exception' file for future use. If a match is made the indicia information is used (box 322) to begin building a replenishment order and corresponding shipment request. For example, a simple alphanumeric-text type search may be performed of the accessible database information 402, 432, 442 to find a package record that contains a package serial number (PSN) match to the PSN of the indicia as transmitted (see box 314). Also, the indicia information is preferably used to update and review an inventory file record maintained by the remote processor for the dispensing site prior to generating the order for acceptance.

It may be desired, but certainly not critical, to include suitable means of communicating an initial 'first-pass' order to an order-authorization site (such as an interactive display monitor, FAX 405 or other hardcopy printing device 403, connected to remote processor 400). Also, the first-pass order may be communicated to someone at the dispensing site 410 for update and/or modification (such as by display monitor at the dispensing location 410, or FAX 412 or other hardcopy printing device 413, connected to remote processor 410). If a first-pass (or any updated or later-modified version, for that matter) of the order is rejected for any reason (327), this information must be communicated to the dispensing site 410, preferably via WAN 420. Action necessary (arrow 328) can be taken to move the order to the next step, 329: Send the replenishment order and shipping request to a credit module for automatic approval or rejection. If credit approval is given 330, the final version of the order and shipping request is sent to a transport planning system to choose carrier (based upon availability, location, cost, etc. at 440) and check on product availability (430) for fulfillment of the order. If credit approval for the order is not given (330), an individual may have to seek payment and/or payment guarantee elsewhere and communicate this (box 332) to the remote processor for order fulfillment (334).

An approved order and shipping request (box 330) can be assigned an order-tracking number, and if desired to keep track of multiple shipments, a shipment number can be assigned to each such shipment. Once an order and shipping request has been sent to a transport planning system 334, the transport planning system can access an off-site processor (440) and/or sub-databases to collect information to find an available common-carrier and plus make a decision about which carrier is most cost-effective, and so on. A warehouse management system (WMS), whether run as a module on the remote processor 400 or performed off-site on a warehouse computer processor 430, can be employed to locate available stock of vessels of fluent substance in accordance with the approved order and shipping request (box 330). The WMS can include the capability to manage the stock picking and packaging processes by way of communicating with warehouse employees via portable-wireless device. The remote processor 400 can be notified (via the WAN 420, for example) that a particular shipment of a particular order has been picked from the warehouse and is on a carrier vehicle heading to the dispensing site. The remote processor can automatically generate an invoice for that shipment and update an internal-local accounts receivable database, as well as electronically send the invoice or print a copy for postal mailing. Once the shipment safely reaches its destination, information concerning the vessels of that shipment can be transmitted to the remote processor for updating the database 402 in a manner similar to that set for at steps 312 and 314 in FIG. 12. It should be noted, that very powerful computer systems (whether personal computers, workstations, or mainframe computers) are commercially available for readily handling the computing tasks described above in connection with FIGS. 12 and 13 in a cost-effective manner.

While certain representative embodiments and details have been shown merely for the purpose of illustrating the invention, those skilled in the art will readily appreciate that various modifications may be made to the invention without departing from the novel teachings or scope of this invention. Accordingly, all such modifications are intended to be included within the scope of this invention as defined in the following claims. Although the commonly employed preamble phrase "comprising the steps of" may be used herein, or hereafter, in a method claim, the Applicants in no way intends to invoke Section 112 ¶6. Furthermore, in any claim that is filed hereafter, any means-plus-function clauses used, or later found to be present, are intended to cover the structures described herein as performing the recited function and not only structural equivalents but also equivalent structures.

What is claimed is:

1. An apparatus for transporting a fluent substance for dispensing during a production process that is separate from a filling-site, comprising:

a flexible-walled vessel compatible with the fluent substance; said vessel comprising, as oriented by a support framework for the dispensing, an upper-end and a lower-portion having at least one port through which the fluent substance is dispensed during the production process;

said upper-end and a lower-end of said lower-portion having been hermetically formed; and said port in communication with a primary flow channel and a valve for controlling, independent of said support framework, the dispensing of a preselected amount of the fluent substance contained in said vessel as needed during the production process.

2. The apparatus of claim 1 wherein the fluent substance is selected from the group consisting of liquid reagents, cleaning solutions, solvents, and pesticides; and further comprising an outwardly-facing indicia on said vessel for use in connection with the process.

3. The apparatus of claim 2 wherein said upper-end and said lower-end have been hermetically formed from tubular stock that is polymeric and generally inert to the fluent substance selected from the group consisting of flexible poly-vinyl chloride (PVC) film and flexible multi-layer film; and the apparatus further comprises an indicia on said vessel having bar coding for tracking use of the vessel during the process.

4. The apparatus of claim 1 wherein a pillow-shaped volume of said vessel formed between said ends has a capacity greater than that required to contain said preselected amount; said primary flow channel passes through and is hermetically sealed to said lower-end; and a support opening is integrated within said upper-end; and said one port is also used for the filling of said vessel at the filling-site.

5. The apparatus of claim 1 wherein said support framework comprises a stand with a base and a projection that fits through a support opening integrated within said upper-end to hold said vessel for the dispensing; and further comprising a plug-in assembly for insertion into said port, said assembly comprising said primary flow channel and said valve.

6. The apparatus of claim 1 wherein said support framework comprises relatively-rigid forward and aft walls, an acute angle between which said vessel is positioned for the dispensing, and a lower aperture through which said primary flow channel fits for the dispensing; and the apparatus further comprises a tubular-extension in communication with said primary flow channel, said valve operatively arranged along said tubular-extension.

7. The apparatus of claim 1 wherein a pillow-shaped volume of said vessel formed between said ends has a capacity greater than that required to contain said preselected amount; said lower-end has a wall through which said primary flow channel, along with a second flow channel, pass and are hermetically integrated; and said second flow channel, in communication with a second port of said lower-end, is used for filling said vessel at the filling-site; and said second flow channel being permanently blocked once said vessel has been filled.

8. The apparatus of claim 1 wherein said upper-end and a lower-end of said lower-portion have been hermetically formed into polymeric sheet material such that: a volume of said vessel is formed between said ends having a capacity greater than that required to contain said preselected amount; and said valve is operatively arranged at said at least one port.

9. An apparatus for transporting a fluent substance for dispensing during a test process that is separate from a filling-site, comprising:

a flexible-walled vessel compatible with the fluent substance, which is not for mammalian consumption; said vessel comprising, as oriented by a support framework for the dispensing, an upper-end and a lower-portion having at least one port through which the fluent substance is dispensed during the test process; said port in communication with a primary flow channel and a valve for controlling the dispensing of a preselected amount of the fluent substance contained in said vessel, as needed; and an outwardly-facing indicia on said vessel for use in connection with the test process.

10. The apparatus of claim 9 wherein the fluent substance is selected from the group consisting of liquid reagents, cleaning solutions, solvents, pesticides.

11. The apparatus of claim 9 wherein said upper-end and a lower-end of said lower-portion have been hermetically formed from polymeric tubular stock material such that: a pillow-shaped volume of said vessel is formed between said ends having a capacity greater than that required to contain said preselected amount; said primary flow channel passes through and is hermetically sealed to said lower-end; and a flow-meter device is operatively arranged downstream of said port; and said indicia comprises alphanumeric coding for inventory control of the fluent substance.

12. The apparatus of claim 9 wherein said upper-end and a lower-end of said lower-portion have been hermetically formed into polymeric sheet material such that: a volume of said vessel is formed between said ends having a capacity greater than that required to contain said preselected amount; said primary flow channel is hermetically sealed to a sidewall of said lower-portion; and the apparatus further comprises a second flow channel used for filling said vessel at the filling site, in communication with a second port of said upper-end; and said second flow channel being permanently blocked once said vessel has been filled.

13. The apparatus of claim 9 wherein said support framework comprises a stand with a base and a projection that fits through a support opening integrated within said upper-end to hold said vessel for the dispensing; and said upper-end and a lower-end of said lower-portion have been hermetically formed from polymeric tubular material generally inert to the fluent substance selected from the group consisting of flexible poly-vinyl chloride (PVC) film and flexible multi-layer film.

14. The apparatus of claim 9 wherein said support framework comprises relatively-rigid forward and aft walls between which said vessel is positioned for the dispensing, and a lower aperture through which said primary flow channel fits for the dispensing; and the apparatus further comprises a tubular-extension in communication with said primary flow channel, said valve operatively arranged along said tubular-extension.

15. The apparatus of claim 9 wherein: said indicia comprises alphanumeric coding for inventory control of the fluent substance, a portion of said indicia is machine-readable for transmission to a remote processor; and said valve is operatively arranged at said at least one port.

16. An apparatus for transporting a fluent substance for dispensing during a production process, comprising:

a flexible-walled vessel compatible with the fluent substance, the fluent substance being selected from the group consisting of liquid reagents, cleaning solutions, solvents, and pesticides;

an outwardly-facing indicia on said vessel;

said vessel comprising an upper-end and a lower-portion having at least one port through which the fluent substance is dispensed during the production process; and said port in communication with a primary flow channel and a valve for controlling, independent of a support framework for said vessel, the dispensing of a preselected amount of the fluent substance contained in said vessel as needed during the production process.

17. The apparatus of claim 16 wherein said upper-end and a lower-end of said lower-portion have been hermetically formed from tubular stock such that: a volume of said vessel is formed between said ends, and a vertical channel is hermetically integrated along a side of said vessel to accommodate a support-stem of a framework to orient said vessel for the dispensing.

18. A method of transporting a fluent substance for dispensing during a production process, comprising the steps of:

providing a flexible-walled vessel with an upper-end and a lower-portion having at least one port in communication with a primary flow channel and a valve, said flexible-walls made of a material compatible with the fluent substance;

filling said vessel, for the transporting, with the fluent substance at a filling-site that is separate from the production process;

orienting said vessel by a support framework; and dispensing through said valve independent of said support framework, as needed, a preselected amount of the fluent substance contained in said vessel.

19. The method of claim 18 wherein said step of filling uses a fluent substance selected from the group consisting of liquid reagents, cleaning solutions, solvents, and pesticides; and said step of providing further comprises including an outwardly-facing indicia on said vessel for use in connection with the production process.

20. The method of claim 19 wherein said step of providing further comprises hermetically forming said upper-end and a lower-end of said lower-portion into polymeric sheet material such that a volume of said vessel is formed between said ends having a capacity greater than that required to contain said preselected amount; and said step of orienting further comprises inserting at least a portion of a projection of said support framework through a support opening integrated within said upper-end.

21. The method of claim 18 wherein: said step of providing further comprises hermetically forming said upper-end and a lower-end of said lower-portion into flexible sheet material; said step of filling further comprises filling said vessel though said at least one port; and said step of orienting further comprises positioning said vessel between relatively-rigid forward and aft walls of said support framework such that said primary flow channel fits through a lower aperture of said framework for the dispensing.

22. The method of claim 18 wherein:

said step of providing further comprises including an outwardly-facing indicia on said vessel and a second flow channel for carrying out said step of filling using a fluent substance selected from the group consisting of liquid reagents, cleaning solutions, solvents, and pesticides; and said step of dispensing further comprises opening said valve, having been operatively arranged along a tubular-extension in communication with said primary flow channel, long enough to dispense said preselected amount, and then closing said valve to temporarily prevent further dispensing of the fluent substance.

23. The method of claim 18 wherein: said step of providing further comprises hermetically forming said upper-end and a lower-end of said lower-portion from polymeric tubular stock material; said step of dispensing further comprises opening said valve, having been operatively arranged at said at least one port in communication with said primary flow channel, long enough to dispense said preselected amount, and then closing said valve to temporarily prevent further dispensing of the fluent substance.

24. A method of transporting a fluent substance for dispensing during a test process, comprising the steps of:

providing a vessel with: flexible-walls made of a material compatible with the fluent substance, which is not for mammalian consumption; an outwardly-facing indicia;

and an upper-end and a lower-portion having at least one port in communication with a primary flow channel and a valve;

filling said vessel, for the transporting, with the fluent substance at a filling-site that is separate from the test process;

orienting said vessel by a support framework; and dispensing through said valve independent of said support framework, as needed, a preselected amount of the fluent substance contained in said vessel.

25. The method of claim 24 wherein: said step of providing further comprises hermetically forming said upper-end and a lower-end of said lower-portion into flexible sheet material; said step of filling uses a fluent substance selected from the group consisting of liquid reagents, cleaning solutions, solvents, and pesticides; and said step of dispensing further comprises measuring said preselected amount with a flowmeter device operatively arranged upstream of said valve.

26. The method of claim 24 wherein: said step of providing further comprises including a second flow channel, in communication with a second port of said upper-end, for carrying out said step of filling; and further comprising the steps of permanently blocking said second flow channel once said vessel has been filled, and controlling inventory of the fluent substance using an alphanumeric coding indicia.

27. The method of claim 24 wherein said step of providing further comprises hermetically forming said upper-end and a lower-end of said lower-portion into polymeric sheet material such that a volume of said vessel is formed between said ends having a capacity greater than that required to contain said preselected amount; and a plug-in assembly comprises said primary flow channel and said valve for insertion into said port prior to said step of dispensing.

28. The method of claim 24 wherein said and said step of orienting further comprises inserting at least a portion of a projection of said framework through a support opening integrated within said upper-end; and further comprising the step of, prior to said step of dispensing, rolling a base of said support framework to locate said framework within the test process for said step of dispensing.

29. The method of claim 24 wherein said step of providing further comprises hermetically forming said upper-end and a lower-end of said lower-portion from polymeric tubular stock material such that a volume of said vessel is formed between said ends having a capacity greater than that required to contain said preselected amount; and said step of dispensing further comprises opening said valve, having been operatively arranged at said at least one port in communication with said primary flow channel, long enough to dispense said preselected amount, and then closing said valve to temporarily prevent further dispensing of the fluent substance.

* * * * *